United States Patent [19]

Chen

[11] Patent Number: 5,035,427

[45] Date of Patent: Jul. 30, 1991

[54] BALL HITTING AND RECEIVING DEVICE

[76] Inventor: Pan B. S. Chen, P.O. Box 15316, Arlington, Va. 22215

[21] Appl. No.: 584,567

[22] Filed: Sep. 17, 1990

[51] Int. Cl.[5] ..... A63B 59/00; A63B 65/00

[52] U.S. Cl. ..... 273/67 R; 273/318

[58] Field of Search ..... 273/318, 323, 324, 326, 273/346, 412, 67 R, 67 C

[56] References Cited

U.S. PATENT DOCUMENTS

| | | | |
|---|---|---|---|
| 653,483 | 7/1900 | McCrea | 273/73 C |
| 1,075,041 | 10/1913 | Kirkness | 273/323 X |
| 2,480,264 | 8/1949 | Regenold | 273/328 |
| 3,115,129 | 12/1963 | Merriman | 273/323 X |
| 3,814,430 | 6/1974 | Leumi | 273/67 R X |
| 4,302,017 | 11/1981 | Huqueriza | 273/323 |
| 4,527,801 | 7/1985 | Lambert | 273/323 |

FOREIGN PATENT DOCUMENTS

| | | | |
|---|---|---|---|
| 24798 | of 1910 | United Kingdom | 273/326 |

*Primary Examiner*—William H. Grieb

[57] ABSTRACT

A ball hitting and receive device, comprising mainly a longitudinal portion, and a transverse portion formed integrally or connected with the longitudinal portion, wherein at least one open section is provided on the transverse portion or the longitudinal portion for receiving a ball for a relatively short time, at least one cavity is provided on the transverse portion or the longitudinal portion for receiving the ball for a relatively long time, and at least one striking face is provided on the transverse portion or the longitudinal portion.

5 Claims, 1 Drawing Sheet

BALL HITTING AND RECEIVING DEVICE

BACKGROUND OF THE INVENTION

This invention relates to a device for playing a ball game, particularly to a device for hitting a ball, and receiving a ball for a relatively short time, or for a relatively long time.

Related prior arts are: Huqueriza U.S. Pat. No. 4,302,017; Leumi U.S. Pat. No. 3,814,430; Merriman U.S. Pat. No. 3,115,129; Regenold U.S. Pat. No. 2,480,264; Kirkness U.S. Pat. No. 1,075,041; and McCrea U.S. Pat. No. 653,483.

The present invention is directed to an improved ballhandling device of the general type of devices mentioned in the prior arts listed hereinabove but is considered to present novel and distinct features not heretofore known in the art.

OBJECT OF THE INVENTION

It is the main object of this invention to provide a ball game device useful for physical exercise or entertainment in which skills and "strategy" are required to win a game.

Another object of the invention is to provide a ball game device which can be utilized in playing a ball game on a conventional field of soccer, polo, football, hockey, or the like, and which involves the use of the devices and at least one ball in which two teams of players may engage.

BRIEF SUMMARY OF THE INVENTION

In accordance with the embodiments of the present invention, a ball game device for hitting and receiving a ball comprises mainly a longitudinal portion and a transverse portion integrally formed with, or fastened to one end (lower end) of, the longitudinal portion. The transverse portion or the longitudinal portion has at least one face for striking a ball. An open section for receiving a ball for a relatively short time is provided on the longitudinal portion or the transverse portion. The longitudinal portion provides a handle near its upper end. Furthermore, another open section or cavity for receiving a ball for a relatively long time is provided on the transverse portion, the longitudinal portion, or the combination thereof.

BRIEF DESCRIPTION OF THE DRAWING

The invention will now be more fully described with reference to the accompanying drawing wherein.

DETAILED DESCRIPTION

Figure 1:
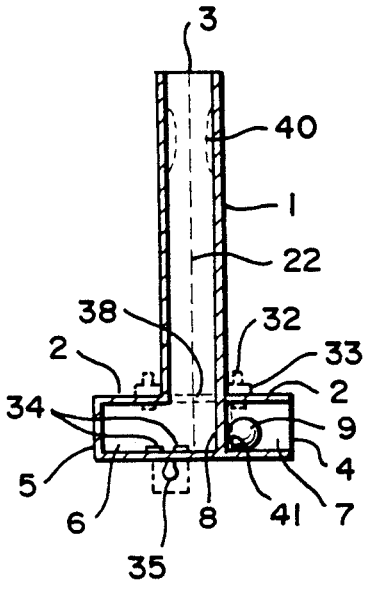
FIG. 1 is a cross-sectional view of a first embodiment of the device.
Figure 2:
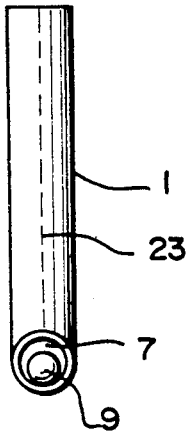
FIG. 2 is a side elevational view of the first embodiment.

Referring now to FIGS. 1 and 2 of the drawing, the first embodiment of the ball game device of this invention comprises generally a longitudinal portion (preferably of cylindrical hollow shape) and a transverse portion 2 (preferably of same shape). These two portions 1 and 2 can be formed integrally or can be fastened together with appropriate fasteners 32 (shown in FIG. 1 with dotted line). If they are fastened together with fasteners, the lower end of the longitudinal portion 1 can be provided with transversely extended part 33 (shown in FIG. 1 with dotted line) so that the fasteners can be inserted therethrough.

In the drawing, each part is not drawn to scale, i.e. the relative dimension of each part can be changed according to the practical requirement. This device can be made of plastic, metal, wood, FRP, rubber or any other type of material or the combination thereof. The outer face of this device can be covered with elastomeric, resilient, or foam material in order to protect this device and prevent the player from being injured.

The longitudinal portion 1 is hollow with an open end 3 on its upper end. The transverse portion 2 is also hollow with an open end 4 on one side and an end plate 5 on the other side. The end plate 5 can be formed integrally with the transverse portion 2 or fastened thereto with appropriate fasteners. A partition plate 8 divides the interior of the transverse portion 2 into two sections, i.e., an open section 7 and a cavity 6. A ball 9 can be received in the open section 7 (as shown in the drawing) for a relatively short time. It can also be received in the cavity 6 for a relatively long time.

The hand-held area (near the upper end of the longitudinal portion 1) may be overlaid with a band of suitable non-slippery material, such as fabric, canvas, rubber, leather or the like in order to insure a firm manual grip thereof.

Before the beginning of the game, two teams of players (except goalkeeper and/or some defense player(s)) can stand in each team's territory (i.e., the half of the field on the side of the goalkeeper of the team) near the half-way line with at least one ball (preferably the number of the balls equals to that of the players in each team) at the middle part of the half-way line. Each player can hold a device of this invention.

After the beginning of the game, the players try to drive (strike) the ball(s) through the goal of the opponent team to score, by striking the ball(s) with the end plate 5 or the like of the device. At any time, the player can catch (receive) the ball 9 from ground (or near ground) with the ball 9 going through the open end 4 or from the "air" (i.e., a certain height, e.g., 3 feet above the ground) with the ball 9 going through the open end 3, so that the ball 9 can be received in the open section 7 or the cavity 6.

It is easier for a player to receive a ball 9 in the open section 7, but a ball 9 in the open section 7 can be removed from the open section 7 accidentally (e.g., if the player does not keep the open section 7 upward properly), or because a player of the opponent team strikes the device having the ball 9 in it in order to get control of the ball 9. On the other hand, it is difficult for a player to receive a ball 9 in the cavity 6, but it is not easy for a ball 9 in the cavity 6 to fall under the control of a player of the opponent team until the player having the ball 9 in the cavity 6 brings the device upside down at an appropriate site (e.g., somewhere near the half-way line in the "territory" of his or her team) at an appropriate time (e.g., no player of the opponent team is too close to him or her).

The ball 9 can be put into the cavity 6 because a player catches it from the "air" with the open end 3 (as mentioned hereinbefore), or a player can receive the ball 9 in the open section 7 and seek an appropriate site and time to toss the ball 9 up to the air by swinging upwardly the device and then catching it with the ball going through the open end 3, or to transfer the ball 9 to the device held by another player of the same team, by having the ball 9 going through the open end 3 of the device held by the said other player to the cavity 6 thereof. (This shows teamwork among the players of the same team.)

The device of this invention, preferably the transverse portion 2, can be made of a transparent material or some microswitches 34 (shown in FIG. 1 with dotted line) can be installed at the wall of the cavity 6 to energize a bulb 35 (shown in FIG. 1 with dotted line) when a ball 9 is being received in the cavity 6. Thus other players may know that the cavity 6 of the device is receiving a ball 9.

Figure 3:
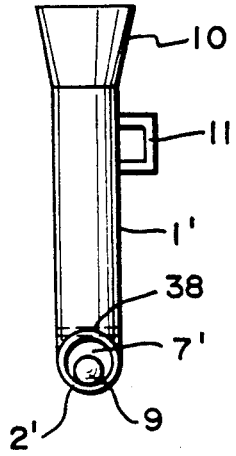
FIG. 3 is a side elevational view of a second embodiment of the device.

FIG. 3 shows a second embodiment of this invention, in which at least one ear-shaped handle 11 can be provided on the longitudinal portion 1' to facilitate the manipulation of the device. A funnel-shaped upper end 10 of the longitudinal portion 1' is provided to facilitate the entering of the ball 9 to the cavity. The structure of the other parts of this embodiment (e.g., the transverse portion 2' or the open section 7') are the same as that of the first embodiment.

Figure 4:
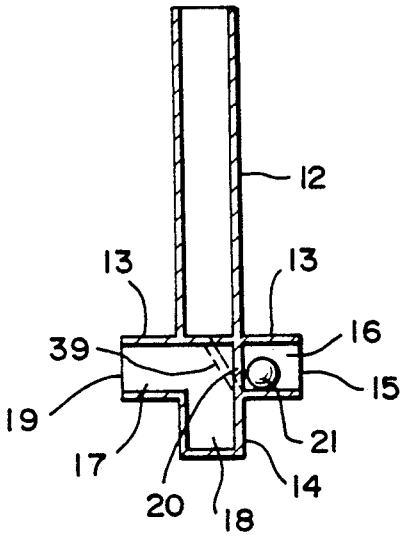
FIG. 4 is a cross-sectional view of a third embodiment of the device.
Figure 5:
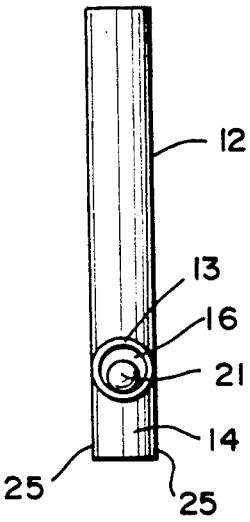
FIG. 5 is a side elevational view of the third embodiment.

FIGS. 4 and 5 shows a third embodiment of this invention. This device has a longitudinal portion 12, a transverse portion 13, an extended longitudinal portion 14, an open end 15 of the transverse portion 13, another open end 19 of the transverse portion 13 communicating with a cavity 18 in the extended longitudinal portion 14, and a partition plate 20 dividing the transverse portion 13 into two open sections 16 and 17, and a ball 21. In this embodiment, striking faces 25 are provided at different locations from that of the first or second embodiment. Some "buffer" material 41 (shown in FIG. 1 with dotted line) can be provided on the surfaces of the partition plate 8 or 20 to prevent the ball from being "bounced" out of the device when a player is catching the ball.

In the third embodiment, the longitudinal portion 12 can be solid instead of hollow.

Figure 6:
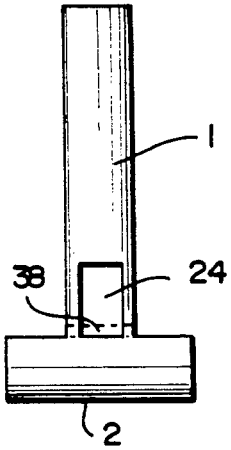
FIG. 6 is an elevational view of a fourth embodiment of the device.
Figure 8:
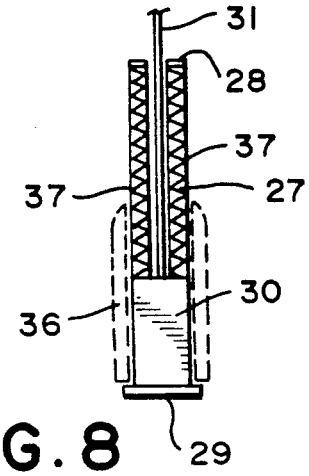
FIG. 8 is an enlarge elevational schematic view showing a cover mechanism in the fourth embodiment.

FIG. 6 shows a fourth embodiment of this invention. The structure of all parts in this embodiment can be the same as that of the first or second embodiment except that an opening 24 is provided on the longitudinal portion 1 so that a ball can enter the cavity 6 through the opening 24. A cover 30 (FIG. 8) can be provided to cover the opening 24. The cover 30 can be slid in a tract 36 (shown in FIG. 8 with dotted line) by pulling or releasing an actuating line 31. Springs 27 can be positioned in tracks 37 (shown in FIG. 8) to be prevented from moving transversely. Springs 27 bias the cover 30 so that the cover 30 can be at normally closed position. Stoppers 28 and 29 on the longitudinal portion 1 help to keep the springs 27 and the cover 30 at place.

Figure 7:
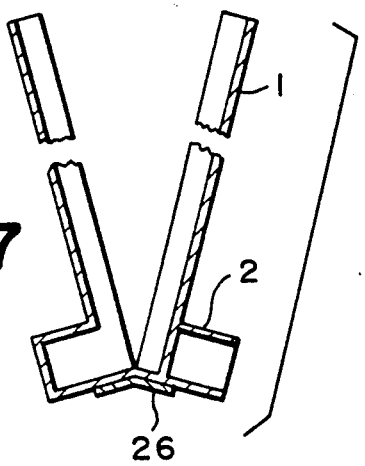
FIG. 7 is a cross-sectional view of a fifth embodiment.

In FIGS. 1 and 2, broken lines 22 and 23 show center lines of elevational and side views of this device respectively. This device can be made of two equal or almost equal parts divided by the lines 22 or 23, and connected together with at least one hinge. For example, in FIG. 7, a hinge 26 is provided under the transverse portion 2. In this example, the device can be opened to receive a ball. At least one ear-shaped handle similar to that shown in FIG. 3 can be provided to facilitate the opening or closing of the device.

In the example in which the device is divided by the line 23 (FIG. 2), the hinge can be provided on the end plate 5 and the outer face of the hinge can flush with the outer face of the end plate 5 so that the end plate 5 can still serve as a striking face.

In FIG. 1, the left section (about one-third of the total portion) can be eliminated and the end plate 5 can be aligned with the left face (FIG. 1) of the longitudinal portion 1.

In the first, second or fourth embodiment shown in FIG. 1, 3 or 6, a partition face 39 (shown in FIG. 4 with dotted line) can be provided between the two portions 1 and 2. Thus the longitudinal portion 1 can also serve as a cavity for receiving the ball for a relatively long time.

The opening 24 in FIG. 6 can serve as an open end of an open section on the longitudinal portion for receiving the ball for a relatively short time. In this case, the openable end plate 5 mentioned hereinabove can make the transverse portion 2 in FIG. 1 serve as a cavity for receiving the ball for a relatively long time if a partition plate is provided between the transverse portion and the longitudinal portion (as shown in FIG. 4).

In this invention, the longitudinal portion can also serve as a striking face (preferably provided with at least a flat face).

Various other variations can be made, e.g., an inclined face (not shown in the drawings) can be provided on the partition plate 20 (FIG. 4) so that a ball entering the open section 17 can enter the cavity 18 smoothly. Also, a restricted diameter portion 40 (shown in FIG. 1 with dotted line) can be provided on the hand held area to facilitate the manipulation of the device. Furthermore, in FIG. 4, the position of the right section of the transverse portion 13 can be changed so that it is at the same level as (or aligned with) the extended portion 14.

I claim:

1. A ball hitting and receiving device, comprising mainly a longitudinal portion (1), a transverse portion (2), and at least one striking face (5) provided on the transverse portion (2), wherein the longitudinal portion (1) is hollow and has open ends at both ends thereof, the transverse portion (2) is hollow and has an open end at one end (4) thereof, a partition plate (8) is provided to divide the transverse portion (2) into the sections, and the transverse portion (2) has a cutaway part so that the longitudinal portion (1) can communicate with the transverse portion (2) and a ball can go from the longitudinal portion (1) to the transverse portion (2) and vice versa.

2. A ball hitting and receiving device, comprising mainly a longitudinal portion (1), and a transverse portion (2), wherein the longitudinal portion (1) is hollow and has an open end at one end thereof, the transverse portion (2) is hollow and has open ends at both ends (15) and (19) thereof, a partition plate (20) is provided to divide the transverse portion (2) into two sections (16) and (17), and an extended longitudinal portion (14) is connected to the transverse portion (2) and communicates therewith.

3. A ball hitting and receiving device, comprising mainly a longitudinal portion (1), a transverse portion (2), and at least one striking face (5) provided on the transverse portion (2), wherein an opening (24) is provided on the longitudinal portion (1), a cover (30) is provided on the opening (24) for openably covering the same, at least one spring (27) for biasing the cover (3) is provided on the longitudinal portion (1) so that the cover (30) can be at a normally closed position, at least a stopper (30) is provided for keeping the cover (30) and the spring (27) at position, and a line (31) for opening the cover (30) is also provided on the longitudinal portion (1).

4. The device of claim 1 or 2, wherein the transverse portion (2) and the longitudinal portion (1) can be respectively divided into two sections which can be connected with at least one hinge (26).

5. The device of claim 1, 2, or 3, wherein at least a microswitch (34) and a bulb (35) is provided on the device so that the bulb (35) can be illuminated when a ball is being received in the device.

* * * * *